US008438963B2

(12) United States Patent
Cohen

(10) Patent No.: US 8,438,963 B2
(45) Date of Patent: May 14, 2013

(54) HIGH DENSITY CERAMIC BODIES AND COMPOSITE ARMOR COMPRISING THE SAME

(76) Inventor: Michael Cohen, Gush Etzion (IL)

( * ) Notice: Subject to any disclaimer, the term of this patent is extended or adjusted under 35 U.S.C. 154(b) by 2 days.

(21) Appl. No.: 13/226,395

(22) Filed: Sep. 6, 2011

(65) Prior Publication Data

US 2012/0055326 A1 Mar. 8, 2012

Related U.S. Application Data

(60) Provisional application No. 61/380,335, filed on Sep. 7, 2010.

(51) Int. Cl.
*F41H 5/02* (2006.01)

(52) U.S. Cl.
USPC ..... 89/36.02; 89/36; 89/36.01

(58) Field of Classification Search ..... 89/36.01, 89/36.02, 906–909, 917; 428/911, 397; 109/49.5
See application file for complete search history.

(56) References Cited

U.S. PATENT DOCUMENTS

| | | | | |
|---|---|---|---|---|
| 3,705,558 | A | 12/1972 | McDougal et al. | |
| 4,179,979 | A | 12/1979 | Cook et al. | |
| 4,665,794 | A | 5/1987 | Gerber et al. | |
| 4,945,814 | A | 8/1990 | Huet | |
| 5,763,813 | A | 6/1998 | Cohen et al. | |
| 5,972,819 | A | 10/1999 | Cohen | |
| 6,112,635 | A | 9/2000 | Cohen | |
| 6,203,908 | B1 * | 3/2001 | Cohen | 428/397 |
| 8,337,970 | B2 * | 12/2012 | Pfister | 428/40.4 |
| 2009/0078109 | A1 * | 3/2009 | Baxter et al. | 89/36.02 |
| 2009/0114083 | A1 * | 5/2009 | Moore et al. | 89/36.02 |
| 2009/0163346 | A1 | 6/2009 | Cohen | |
| 2010/0170387 | A1 * | 7/2010 | Ravid et al. | 89/36.02 |

FOREIGN PATENT DOCUMENTS

| | | | |
|---|---|---|---|
| EP | 0 843 149 | A1 | 5/1998 |
| EP | 0942255 | A1 | 9/1999 |
| WO | WO-98/15796 | A | 4/1998 |
| WO | WO-99/60327 | | 11/1999 |

* cited by examiner

*Primary Examiner* — Stephen M Johnson
*Assistant Examiner* — John D Cooper
(74) *Attorney, Agent, or Firm* — Foley & Lardner LLP

(57) ABSTRACT

An integrally formed high density ceramic pellet, for use in a ballistic armor plate, has a longitudinally extending body portion and an impact receiving end face. The impact receiving end face includes an impact receiving proximal segment that is convexly curved and a distal segment that merges with a top surface of the body portion. The distal segment has lateral surfaces that have a region including at least a portion which is concave in configuration or a region including a substantially smooth angled configuration. A cross-sectional area of the distal segment at the area of merger is greater than a cross-sectional area taken across a nominally designated base of the proximal segment. The length of the contour line of the outer surface of the distal segment is between 5 and 25% of that of the entire integrally formed impact receiving end face.

36 Claims, 8 Drawing Sheets

4-30

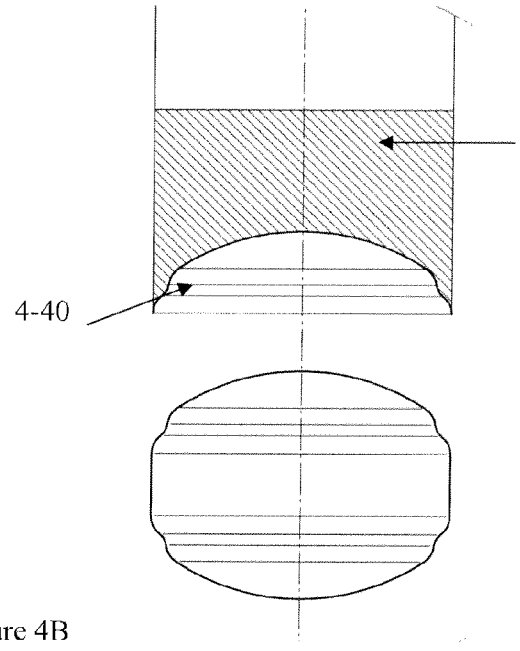
Figure 4B
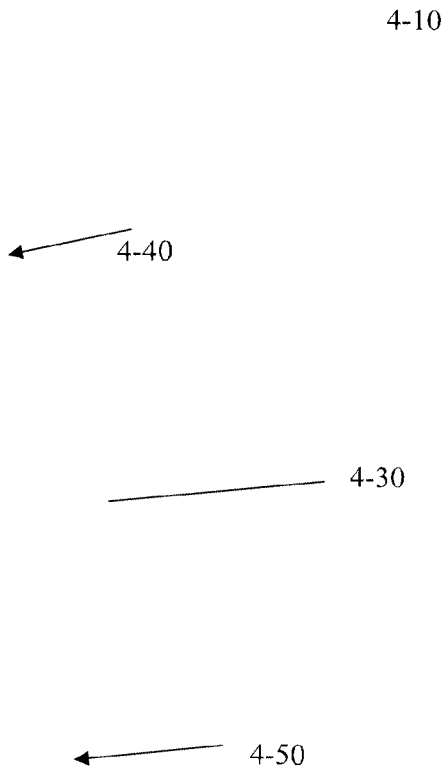

HIGH DENSITY CERAMIC BODIES AND COMPOSITE ARMOR COMPRISING THE SAME

CLAIM OF PRIORITY

This application claims priority from U.S. provisional application No. 61/380,335 filed Sep. 7, 2010, claims the benefit of the Israeli application no. 210327 filed Dec. 28, 2010, and claims the benefit of Russian application no. 2010154317 filed Dec. 29, 2010.

BACKGROUND OF THE INVENTION

Ceramic bodies for use in armored plates for providing ballistic protection for personnel as well as for light and heavy mobile equipment and for vehicles against high-velocity, armor-piercing projectiles or fragments are known in the art.

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m2.

Armor for light vehicles is expected to prevent penetration of bullets of any type, even when impacting at a speed in the range of 700 to 1000 meters per second. However, due to weight constraints it is difficult to protect light vehicles from high caliber armor-piercing projectiles, e.g. of 12.7 and 14.5 mm, since the weight of standard minor to withstand such projectile is such as to impede the mobility and performance of such vehicles.

A second consideration is cost. Overly complex armor arrangements, particularly those depending entirely on synthetic fibers, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and light vehicle armor, which plates have been found to be vulnerable to damage from mechanical impacts caused by rocks, falls, etc.

In addition, of the known armor panels, most suffer the limitation that such panels do not have multi-hit capability.

Thus a light-weight, minor panel, without the above-limitations is as yet lacking.

SUMMARY OF THE INVENTION

In one embodiment, this invention provides an integrally formed high density ceramic pellet for use in a ballistic armor plate, said ceramic pellet having a longitudinally extending body portion and an impact receiving end face wherein at least a major portion of said body portion is either circular or hexagonal in cross-section and said impact receiving end face comprises:

an impact receiving proximal segment; and a distal segment;

wherein said proximal segment is convexly curved and said distal segment of said impact receiving end face merges with a nominally designated top surface of said body portion, wherein said distal segment of said end face comprises lateral surfaces characterized by:

a region comprising at least a portion which is concave in configuration; or a region comprising a substantially smooth angled configuration, wherein a cross-sectional area of said distal segment at the area of merger is greater than a cross-sectional area taken across a nominally designated base of said proximal segment and wherein the length of the contour line of the outer surface of the distal segment in longitudinal cross-section is between 5 and 25% of that of the length of the contour line of the entire integrally formed impact receiving end face in longitudinal cross-section.

In some embodiments, the invention provides a ceramic pellet for use in a ballistic armor plate, said ceramic pellet comprising:

a body portion, comprising:

an axis;

a cross-sectional shape that is symmetrical around the axis; and an end portion representing a terminus of said body portion, said end portion having an outer surface comprising a first and second section, wherein:

said first section has a convex curvature; said first section is spaced from said body portion, and said first section contains a body portion axis extending there-through; and said second section extends around said body portion axis, said second section is located between said first portion and said body portion; and said second section has a first annular edge at or adjacent to said first section and a second annular edge at or adjacent to said body portion;

wherein said second section has a configuration such that substantially each intersection between said second section and planes including a body portion axis extends in a straight line or a configuration such that substantially each intersection between said second section and planes including said body portion axis extends in a line that has a concave curvature when viewed from the exterior of said pellet;

and an end portion;

wherein an average radial distance from said body portion axis to said first annular edge of said second section is at lest 5% less than an average radial distance from said body portion axis to said second annular edge of said second section.

In some embodiments, the cross-sectional shape of said body portion is circular or hexagonal. In some embodiments, the outer surface of said end portion is formed substantially entirely by said first section and said second section.

In some embodiments, the first and second annular edges are circular and in some embodiments, the first and second annular edges are hexagonal. In some embodiments, the first section of said outer surface is comprised of a plurality of individual fragments, which fragments when assembled together assume a convexly curved geometry.

In some embodiments, the invention provides a composite ballistic armor plate, comprising a panel provided with a layer of a plurality of pellets as herein described, wherein said pellets are arranged in a plurality of adjacent rows and columns, the major axis of said pellets being in substantially parallel orientation with each other and substantially perpendicular to an impact receiving surface of said panel.

According to this aspect, and in some embodiments, said panel comprises a plurality of high density ceramic bodies, wherein said integrally formed convexly curved impact receiving end face is so positioned to be proximally located to an impacting projectile, and said integrally formed convexly curved impact receiving end face comprises a distal segment comprising lateral surfaces characterized by:

- a region comprising at least a portion which is concave in configuration; or
- a region comprising a substantially smooth angled configuration.

In some embodiments, the plurality of pellets as herein described, wherein said pellets are arranged in a plurality of adjacent rows and columns wherein the columns are substantially perpendicular to said rows and wherein for each of one of said rows, the ceramic pellets of said each row are spaced from one another and for each of one of said columns the ceramic pellets of said each column are spaced from one another such that each of a majority of said ceramic pellets contacts two pellets in a first adjacent row and two pellets in a second adjacent row, so that each of a majority of the pellets is in contact with four and four alone, adjacent pellets, and where for each row, the centers of adjacent ceramic pellets in said each row are spaced from one another substantially by a first distance for each column the centers of adjacent ceramic pellets in each said column are spaced from one another substantially by a second distance, wherein the first distance is different from the second distance. In some embodiments, the first and second distances is greater than the other one of said first and second distances by a factor of at least from 1.1 to 1.5.

In some embodiments, the pellets are embedded in an elastic material.

In some embodiments, the panel has an inner and an outer surface, said outer surface facing the impact side and said pellets being arranged in a plurality of adjacent rows, the cylindrical axis of said pellets being substantially parallel with each other and perpendicular to the surfaces of the panel with the convexly curved end faces directed to the outer surface. In some embodiments, the panel further comprises an inner layer adjacent said inner surface of said panel, said inner layer being formed from a plurality of adjacent layers, each layer comprising a plurality of unidirectional coplanar anti-ballistic fibers embedded in a polymeric matrix, the fibers of adjacent layers being at an angle of between about 45° to 90° to each other.

In some embodiments, the invention provides a panel provided with a layer of a plurality of the pellets as herein described, wherein said pellets are arranged in a plurality of adjacent rows and columns, the major axis of said pellets being in substantially parallel orientation with each other and wherein a majority of each of said pellets is in direct contact with six adjacent pellets, with the flanks of three adjacent pellets forming a contact valley there-between. In some embodiments, the majority of each of said pellets is substantially in contact with at least three adjacent pellets, further characterized in that spaces formed between said adjacent cylindrical pellets are only partially filled with a material for preventing the flow of soft metal from impacting projectiles through said spaces, said flow-preventing material being integrally formed as part of a special insert pellet, said insert pellet being in the form of a cylinder provided with projections extending only partially into the spaces formed between the sides of six adjacent cylindrical pellets, and blocking a major cross-sectional portion of said spaces, each of said projections being in spaced-apart relationship to al least one of the two adjacent cylinders towards which it projects, said pellets being bound and retained in plate form by a solidified material, wherein said solidified material and said plate are elastic.

In some embodiments, the invention provides a method for producing a high density ceramic body of this invention, the method comprising:

a. applying a ceramic powder to a mold, said mold comprising:
   i. a removable segmented top pressure applicator, which applicator comprises:
      1. a terminal segment having a proximal and distal portion relative to the direction of the application of pressure via said applicator, which proximal portion is concavely curved, and which distal portion is characterized by:
         a. lateral regions comprising at least a portion which is convex in configuration;
         or
         b. lateral regions comprising a substantially smooth angled configuration; and
   ii. a pellet, which pellet is substantially cylindrical in shape and possesses at least one flat or circular bottom end, sides and an top end,
   wherein said top pressure applicator removably inserts into said pellet of said mold; and
b. applying said top pressure applicator to said mold and applying pressure to said mold via said top pressure applicator;

whereby upon application of said pressure to said mold, the high density ceramic pellet as herein described is produced.

BRIEF DESCRIPTION OF THE DRAWINGS

Various embodiments of a ceramic body are described herein with reference to the figures wherein:

FIG. 5 schematically depicts an embodiment of a composite panel of this invention.

DETAILED DESCRIPTION OF THE INVENTION

Figure 1A:
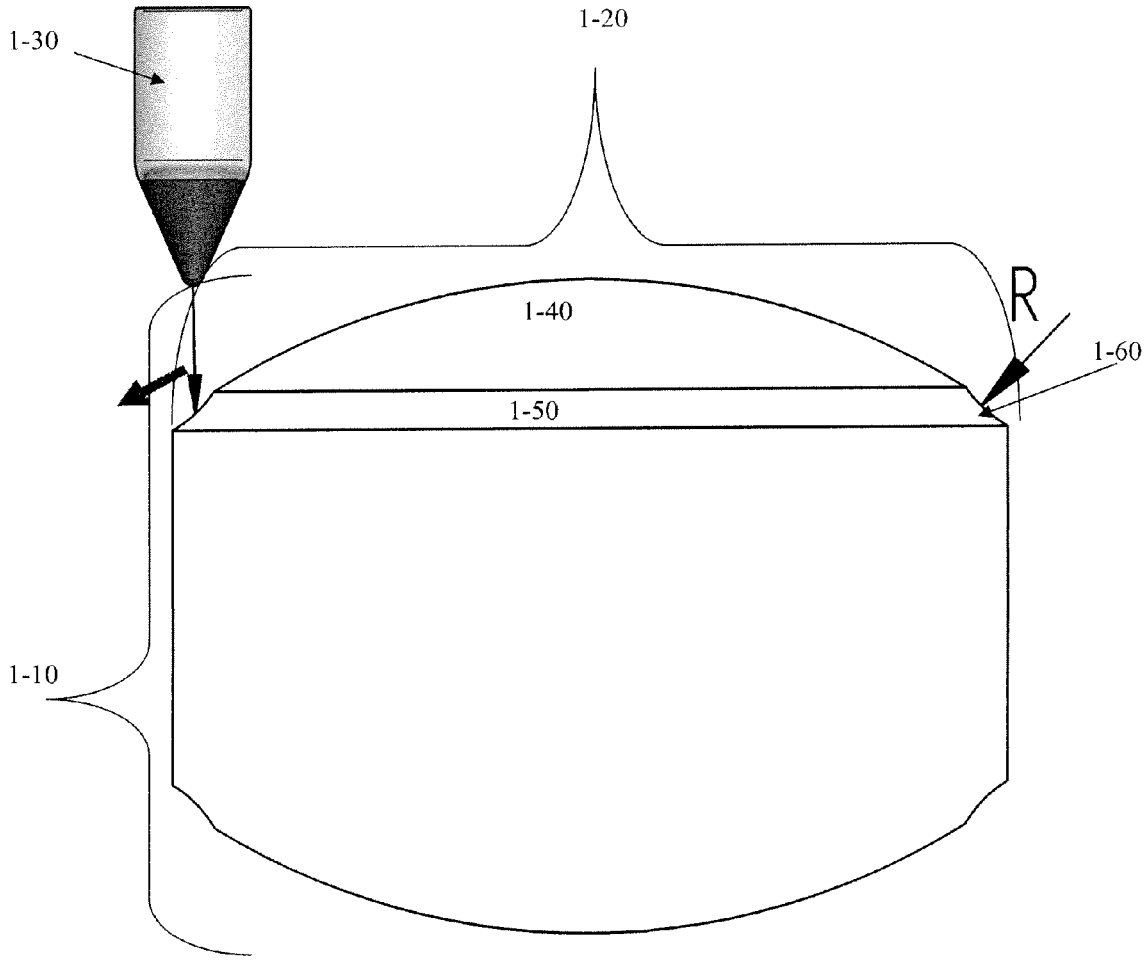
FIG. 1 schematically depicts an embodiment of a ceramic body of this invention, which comprises an integrally formed convexly curved impact receiving end face, having a distal segment comprising lateral surfaces characterized by a region comprising at least a portion which is concave in configuration.

This invention provides, in some embodiments, an integrally formed, high density ceramic body for use in a ballistic armor plate, which may provide protection against high velocity projectiles.

According to this aspect, and in one embodiment, such ceramic bodies are substantially cylindrical in shape and comprise a circular first end.

By the phrase "circular first end" it will be understood that such ceramic bodies may comprise elongated bodies, which bodies contain a terminus, wherein at least one of the termini of such bodies is substantially circular in shape. It will be appreciated that in some embodiments, such first end may be somewhat oval in shape, i.e. the overall shape need not be a perfect circle, but in some embodiments, will approximate a circular shape. In some embodiments, both ends of the ceramic body will be characterized by a substantially circular shape, or in some embodiments, one end may be oval, or flat, while the second end or terminus is substantially circular and any of these embodiments, or variations thereof, will be understood to be encompassed by the invention.

In some embodiments, the ceramic body will comprise an integrally formed substantially convexly curved impact receiving end face of such first end. The convexly curved end face comprises a proximal segment and a distal segment and according to this aspect, the proximal segment is convexly curved and the distal segment of the end face merges with the nominally designated circular first end. According to this aspect, and in one embodiment, the distal segment further comprises lateral surfaces characterized by a region comprising at least a portion which is concave in configuration.

In some embodiments, the integrally formed, substantially convexly curved impact receiving end face will be comprised of a single piece, which piece assumes the overall substantially convex geometry, such that the entire proximal segment of the end face is convexly curved. In some embodiments, the integrally formed, substantially convexly curved impact receiving end face is comprised of a number of fragments or pieces, which together form a convexly curved geometry for the proximal segment. In some embodiments, for example, two hemispheric pieces are seamed together, which form the convexly curved proximal segment, and in some embodiments, four or six, or more segments are seamed together, which segments when assembled together form a convexly curved proximal segment of the substantially convexly curved impact receiving end face. It is to be understood that the substantially convexly curved impact receiving end face is not to be limited in any way by the number of segments or individual shape of segments, which make up the proximal segment, but rather, when viewed as fully assembled, the overall geometry of the assembled segments form a substantially convexly curved impact receiving proximal segment of the end face.

In some embodiments, the invention is directed to a ceramic pellet for use in a ballistic minor plate, said ceramic pellet comprising:

- a body portion, comprising:
  - an axis;
  - a cross-sectional shape that is symmetrical around the axis; and
  - an end portion representing a terminus of said body portion, said end portion having an outer surface comprising a first and second section, wherein:
    - said first section has a convex curvature; said first section is spaced from said body portion, and said first section contains a body portion axis extending there-through; and
    - said second section extends around said body portion axis, said second section is located between said first portion and said body portion; and said second section has a first annular edge at or adjacent to said first section and a second annular edge at or adjacent to said body portion;
      - wherein said second section has a configuration such that substantially each intersection between said second section and planes including a body portion axis extends in a straight line or a configuration such that substantially each intersection between said second section and planes including said body portion axis extends in a line that has a concave curvature when viewed from the exterior of said pellet;
- and an end portion;

wherein an average radial distance from said body portion axis to said first annular edge of said second section is at lest 5% less than an average radial distance from said body portion axis to said second annular edge of said second section.

In some embodiments, whereas the various embodiments of the ceramic pellets as herein described may possess different dimensions, such pellets will be characterized in that they have comparable overall shapes and consistent geometries.

Figure 1B:
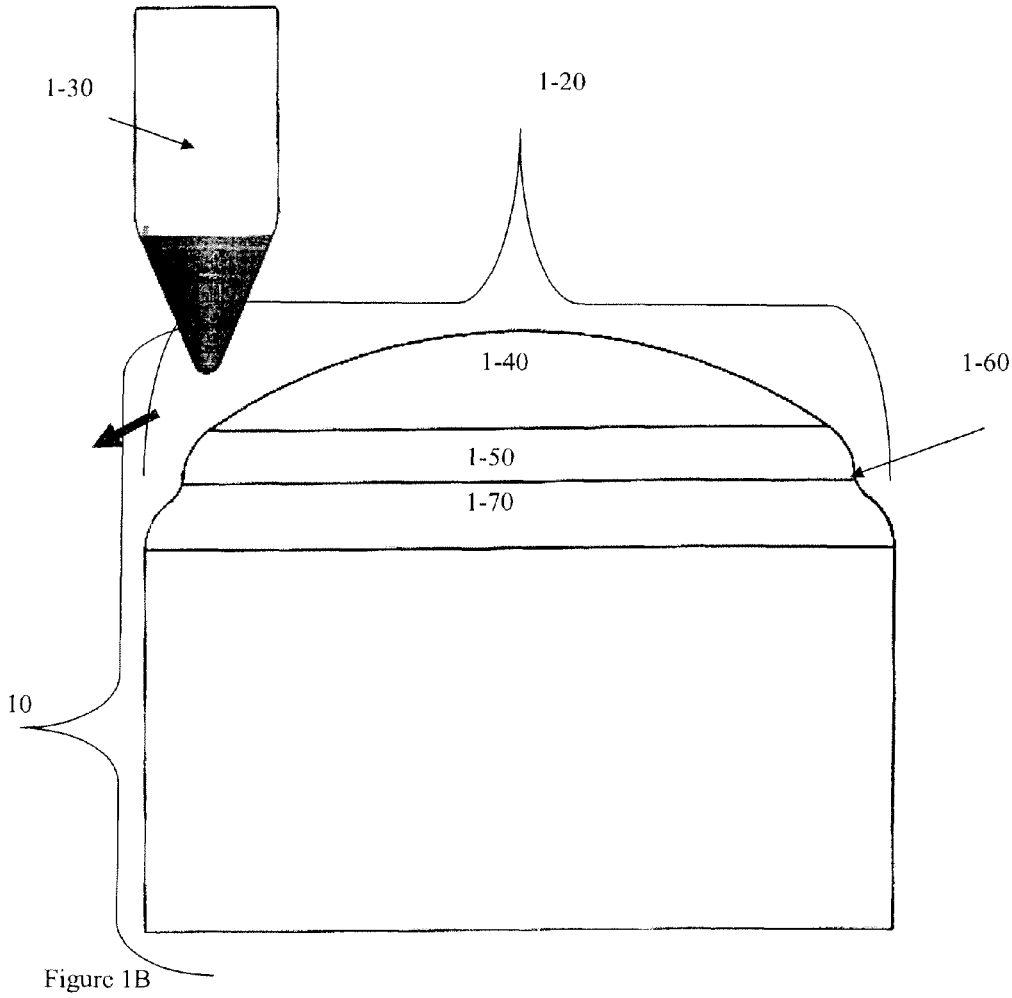

Referring to FIG. 1, which depicts an embodiment of a ceramic body of this invention 1-10, the ceramic body comprises an integrally formed, convexly curved impact receiving end face 1-20, which is located proximal to an incoming projectile 1-30. The convexly curved end face comprises a proximal segment 1-40 and a distal segment 1-50. In this aspect, the distal segment further comprises lateral surfaces characterized by a region comprising at least a portion which is concave in configuration 1-60. According to this aspect, when a projectile approaches and impacts a surface of the ceramic body, for example at a region comprising part of the distal segment (black arrow), the trajectory of the projectile will be altered so that it does not continue along a straight path, but rather, the impact at the concave region will alter the projectile trajectory to be off to the side (gray arrow), and thereby offer protection against the incoming projectile, by in some embodiments, lessening some of the force of the impact, or in some embodiments, dissipating some of the kinetic energy, or in some embodiments, preserving the integrity of the ceramic body, or in some embodiments, a combination of all of the same.

In some embodiments, the contour of the integrally formed impact receiving end face in longitudinal cross-section comprises two convex arcs of different radii, a first of said arcs being located along the surface of said proximal segment; and a second convex arc being located along the surface of said distal segment.

Figure 2:
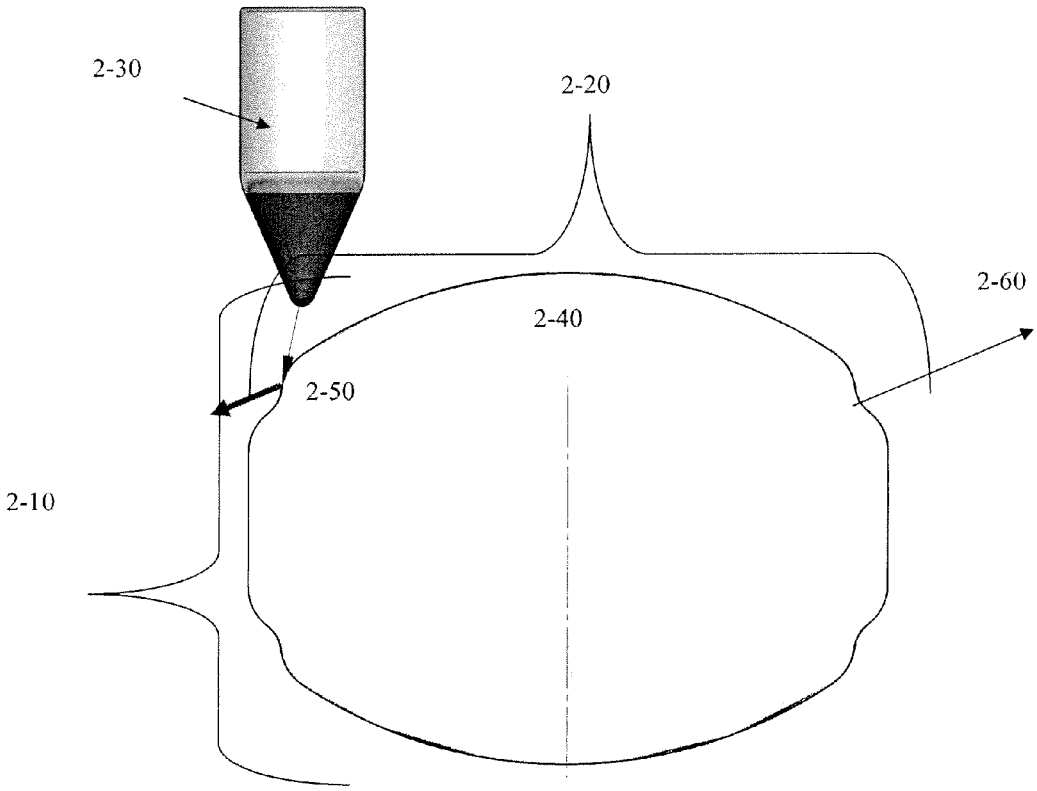
FIG. 2 schematically depicts an embodiment of a ceramic body of this invention, which comprises an integrally formed convexly curved impact receiving end face, having a distal segment comprising lateral surfaces characterized by a region comprising a step configuration.

Referring to FIG. 2, which depicts an embodiment of a ceramic body of this invention, according to this aspect (2-10), wherein the ceramic body comprises an integrally formed, convexly curved impact receiving end face 2-20, which is located proximal to an incoming projectile 2-30. The convexly curved end face comprises a proximal segment 2-40 and a distal segment 2-50. In this aspect, the distal segment further comprises lateral surfaces characterized by a region comprising at least a portion which is concave in configuration 2-60. According to this aspect, when a projectile approaches and impacts a surface of the ceramic body, for example at a region comprising part of the distal segment (black arrow), the trajectory of the projectile will be altered so that it does not continue along a straight path, but rather, the impact at the stepped region will alter the projectile trajectory to be off to the side (gray arrow), and thereby offer protection against the incoming projectile, by in some embodiments, lessening some of the force of the impact, or in some embodiments, dissipating some of the kinetic energy, or in some embodiments, preserving the integrity of the ceramic body, or in some embodiments, a combination of all of the same.

In some embodiments the segment further comprises lateral surfaces characterized by a region comprising a substantially smooth angled configuration.

Figure 3A:
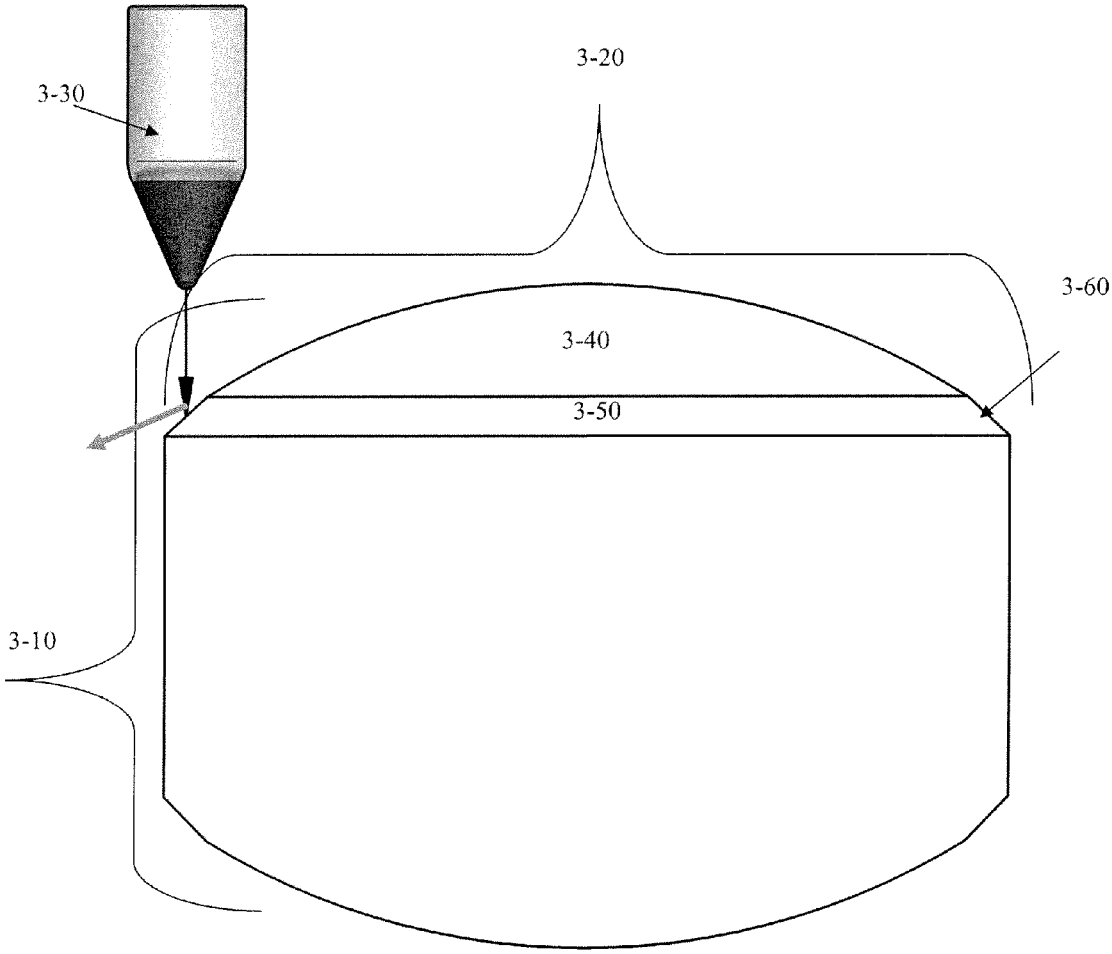
FIG. 3A schematically depicts an embodiment of a ceramic body of this invention, which comprises an integrally formed convexly curved impact receiving end face, having a distal segment comprising lateral surfaces characterized by a region comprising a substantially smooth angled configuration. As will be realized, in this family of preferred embodiments said distal segment is preferably at least partially frustroconical in shape.
Figure 3B:
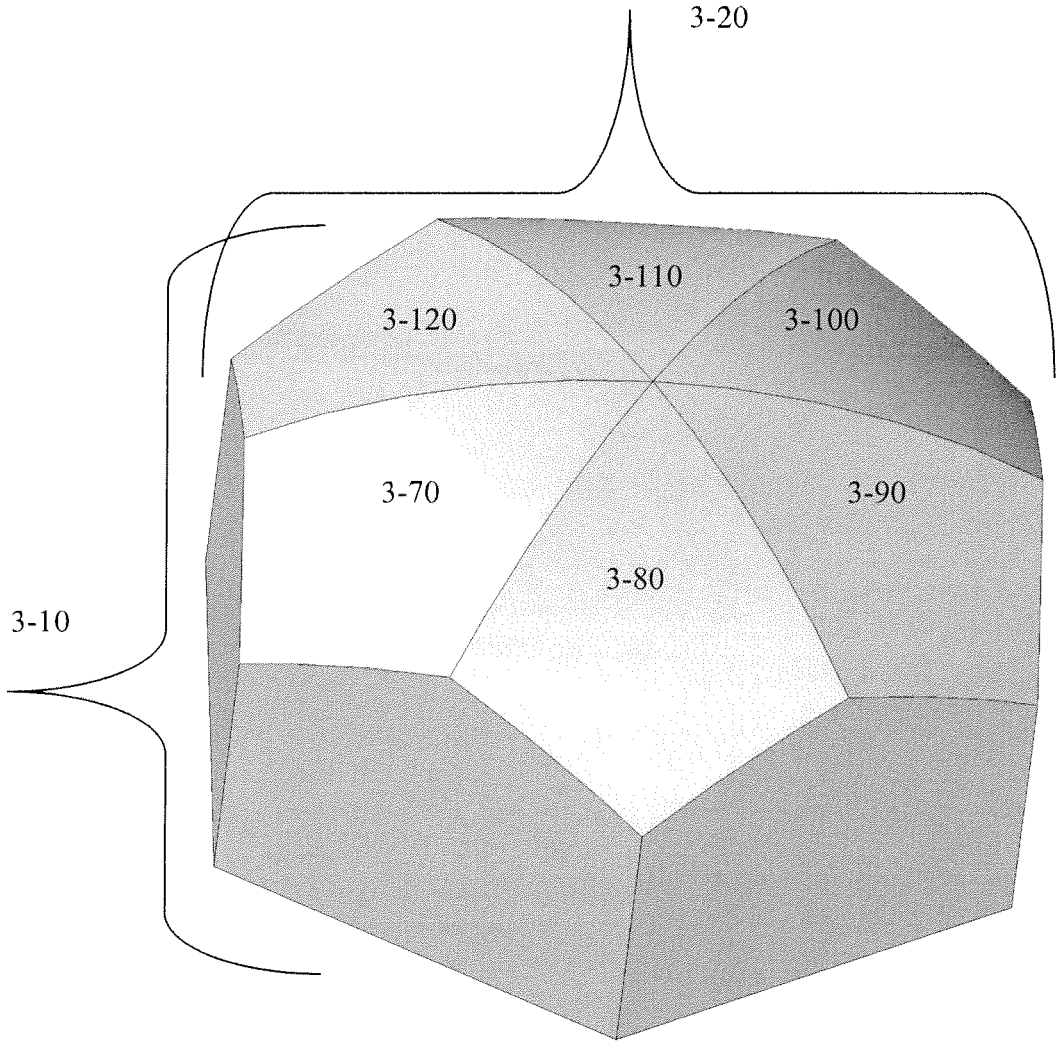
FIG. 3B schematically depicts an embodiment of a ceramic body of this invention, wherein the substantially convexly curved impact receiving end face/first section of the outer surface is comprised of a plurality of individual fragments, which fragments when assembled together assume a convexly curved geometry.

Referring to FIG. 3, which depicts an embodiment of a ceramic body of this invention 3-10, the ceramic body comprises an integrally formed, convexly curved impact receiving end face 3-20, which is located proximal to an incoming projectile 3-30. The convexly curved end face comprises a proximal segment 3-40 and a distal segment 3-50. In this aspect, the distal segment further comprises lateral surfaces characterized by a region comprising at least a portion which is concave in configuration 3-60. According to this aspect, when a projectile approaches and impacts a surface of the ceramic body, for example at a region comprising part of the distal segment (black arrow), the trajectory of the projectile will be altered so that it does not continue along a straight path, but rather, the impact at the stepped region will alter the projectile trajectory to be off to the side (gray arrow), and thereby offer protection against the incoming projectile, by in some embodiments, lessening some of the force of the impact, or in some embodiments, dissipating some of the kinetic energy, or in some embodiments, preserving the integrity of the ceramic body, or in some embodiments, a combination of all of the same.

In some embodiments, according to this aspect, the lateral surfaces are characterized by a region comprising a substantially smooth angled configuration, which smooth angled region, in some embodiments, ascribes an acute angle with the nominally designated circular first end.

In some embodiments, the pellets of this invention are defined as comprising a body portion, and an end portion. According to this aspect and in some embodiments, the body portion comprises an axis, a cross-sectional shape that is symmetrical around the axis and an end portion representing a terminus of the body portion. According to this aspect, and in some embodiments, the end portion has an outer surface comprising a first and second section, wherein the first section has a substantially convex curvature, is spaced from the body portion, and the first section contains a body portion axis extending there-through. According to this aspect, and in some embodiments, the second section extends around the body portion axis, the second section is located between the first portion and body portion; and the second section has a first annular edge at or adjacent to the first section and a second annular edge at or adjacent to the body portion. According to this aspect, and in some embodiments, the second section has a configuration such that substantially each intersection between the second section and planes including a body portion axis extends in a straight line or a configuration such that substantially each intersection between the second section and planes including the body portion axis extends in a line that has a concave curvature when viewed from the exterior of said pellet. According to this aspect, the average radial distance from the body portion axis to the first annular edge of the second section is at least 5% less than the average radial distance from the body portion axis to the second annular edge of the second section.

In some embodiments, the term "substantially" with particular reference to a geometric shape, as with reference to the segment of the ceramic body along the long axis of such body characterized as being substantially cylindrical in shape, or as with reference to the integrally formed substantially convexly curved impact receiving end face, that such term "substantially" means that from at 51%-100% of the referenced element will approximate a shape consistent with the designated geometric shape. Thus, a ceramic body segment along the long axis of such body, which is "substantially cylindrical", will be characterized in that more than 51% of the overall shape of the ceramic body segment will assume a cylindrical shape. Similarly, a substantially convexly curved impact receiving end face will indicate that from at least 51% to about 95% of a contour line of an outer surface of such end face will be convexly curved. According to this aspect, the term "substantially" will provide for a geometric shape which is not 100% concordant with the indicated shape, since as noted herein, the distal segment of the end face is characterized by a configuration which is not convexly curved. Therefore, the term "substantially" refers to an element characterized in that between 51% and 100% assumes the indicated geometry unless such element is precluded from being characterized by assuming 100% of such shape, as described herein, in which case the term "substantially" will refer to an element characterized in that between 51% and 95% of the indicated element will assume the referenced geometry.

In some embodiments, the cross-sectional area of said distal segment at the area of merger is greater than a cross-sectional area taken across a nominally designated base of said proximal segment. In some embodiments, the cross-sectional area of the distal segment is substantially equal to the cross-sectional area of the circular first end.

In some embodiments, the ceramic bodies as described herein are comprised of any suitable material, for example, sintered refractory materials or ceramic materials, for example, aluminum oxide, or in some embodiments, ceramic materials having a specific gravity below that of aluminium oxide, e.g., boron carbide with a specific gravity of 2.45, silicon carbide with a specific gravity of 3.2 silicon aluminum oxynitride with a specific gravity of about 3.2, and others, as will be appreciated by the skilled artisan. In some embodiments, the ceramic bodies as described herein are comprised of a material, for example, as described in EP-A-0843149, European patent application 98301769.0, WO-A-9815796, WO 99/60327, the teachings of each of which is fully incorporated by reference herein.

In some embodiments, the ceramic bodies will be comprised of a material such as sintered oxides, nitrides, carbides and borides of magnesium, zirconium, tungsten, molybdenum, titanium, silica and others In some embodiments, the ceramic bodies will be comprised of a material such as alumina, boron carbide, glass, boron nitride, titanium diboride, silicon carbide, silicon oxide, silicon nitride, magnesium oxide, silicon aluminum oxynitride and mixtures thereof. In some embodiments, the ceramic bodies will be comprised of asintered, yttria stabilized zirconium-toughened alumina ceramic product, such as that described in US20090163346A1, fully incorporated herein by reference.

In some embodiments, the ceramic bodies will be comprised of a material such as glass, sintered refractory material and ceramic material, and having at least one axis of at least 3 mm length and in some embodiments, such ceramic bodies may each have a substantially regular geometric form, and in some embodiments, such ceramic bodies are further characterized in that a channel is provided in each of a said pellets.

In some embodiments, the ceramic bodies will have at least one axis having a length in the range of from about 12 to 40 mm. In some embodiments, when an armored plate comprising such bodies is assembled, such plate will have a weight which does not exceed 185 $kg/m^2$ In some embodiments, different panels or plates may be assembled, comprising ceramic bodies characterized as described above, yet varying in terms of the length, diameter, or a combination thereof of a ceramic body, which in some embodiments, is particularly suited to the varying lengths of projectiles which may come into contact with such panels. In some embodiments, the panels may be thus adjusted to suit coming into contact with projectiles of between 5.56 and 9 mm, or between 22 and 26 mm, as will be appreciated by the skilled artisan. It will be appreciated that panels may be designed to be suitable for exposure to larger projectiles, as well.

In some embodiments, such channels can be bored into preformed pellets or the pellets themselves can be pressed with such channel already incorporated therein.

In some embodiments, the ceramic body has a ratio D/R between the diameter D of said ceramic body and the radius R of curvature of said convexly curved end face which ratio is at least 0.64:1. In some embodiments, the ceramic body has a ratio D/R between the diameter D of said ceramic body and the radius R of curvature of said convexly curved end face which ratio is at least 0.85:1. In some embodiments, the ceramic body has a ratio D/R between the diameter D of said ceramic body and the radius R of curvature of said convexly curved end face which ratio is between at least 0.85:1-1/28:1.

According to this aspect, and in some embodiments, the ratio D/R of the ceramic body with regard to the diameter D of the ceramic body and the radius R of curvature of the convexly curved end face, that such R value is with regard to a proximal segment of the convexly curved end face, and the values described hereinabove are specifically with reference to such proximal segment.

In some embodiments, the relative ratios H/D/R of the height H of said cylindrical body, excluding the height of said convexly curved end face, the diameter of said cylindrical body D, and the radius R of curvature of said at least one convexly curved end face is between about 7.5:12.8:9 and 7.5:12.8:20.

This invention also provides for a composite armor for protection against high velocity projectiles, comprising a panel provided with at least one layer of a plurality of high density ceramic bodies as described herein, wherein said bodies are arranged in a plurality of adjacent rows and columns, the major axis of said bodies being in substantially parallel orientation with each other and substantially perpendicular to an impact receiving surface of said panel, wherein the integrally formed convexly curved impact receiving end faces of each of such ceramic bodies is so positioned in such armor as to face incoming projectiles.

According to this aspect, and in some embodiments, said panel comprises a plurality of high density ceramic bodies, wherein said integrally formed convexly curved impact receiving end face is so positioned to be proximally located or facing an impacting projectile, and said integrally formed convexly curved impact receiving end face of said ceramic bodies comprises a proximal and distal segment as herein described, wherein said distal segment comprises lateral surfaces characterized by:

a region comprising at least a portion which is concave in configuration;

or a region comprising a substantially smooth angled configuration.

It will be appreciated that this invention provides for a composite armor, wherein at least a portion of the ceramic bodies contained within such composite armor are ceramic bodies characterized as described herein. In some embodiments, at least 30% of such ceramic bodies are characterized as described herein, or in some embodiments, at least 40% of such ceramic bodies are characterized as described herein, or in some embodiments, at least 50% of such ceramic bodies are characterized as described herein, or in some embodiments, at least 55% of such ceramic bodies are characterized as described herein, or in some embodiments, at least 60% of such ceramic bodies are characterized as described herein, or in some embodiments, at least 65% of such ceramic bodies are characterized as described herein, or in some embodiments, at least 70% of such ceramic bodies are characterized as described herein, at least 75% of such ceramic bodies are characterized as described herein, or in some embodiments, at least 80% of such ceramic bodies are characterized as described herein, or in some embodiments, at least 85% of such ceramic bodies are characterized as described herein, or in some embodiments, at least 90% of such ceramic bodies are characterized as described herein, at least 95% of such ceramic bodies are characterized as described herein, or in some embodiments, at least 99% of such ceramic bodies are characterized as described herein, or in some embodiments, such composite panels comprise ceramic bodies characterized as described herein exclusively.

Figure 5A:
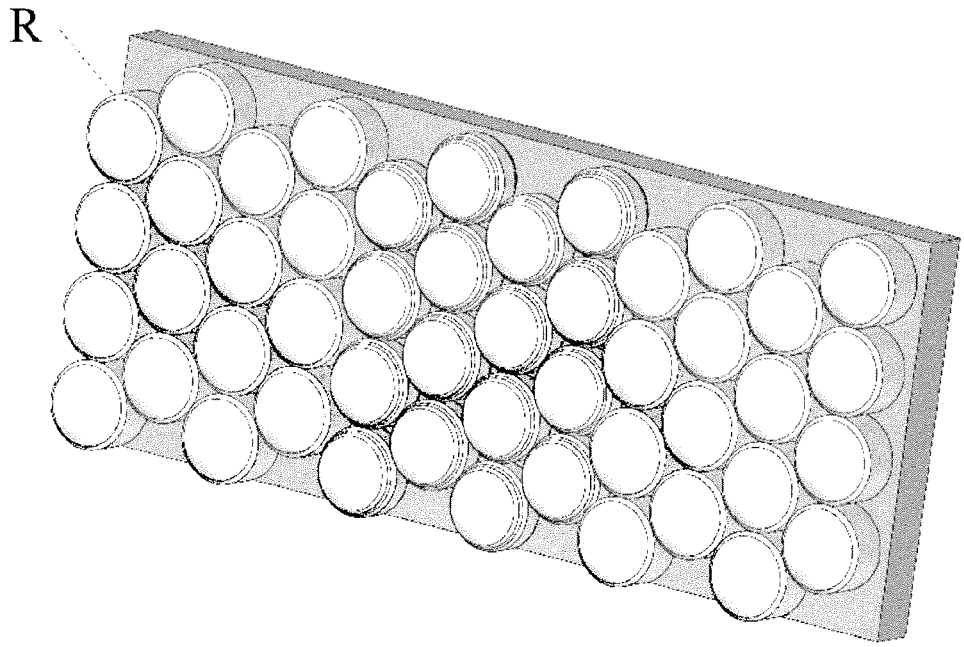
FIGS. 5A and 5B represent line and fill-in diagrams, respectively of a composite panel, which according to this aspect comprises multiple ceramic bodies, wherein the ceramic bodies may include multiple embodiments thereof, as herein described.
Figure 5B:
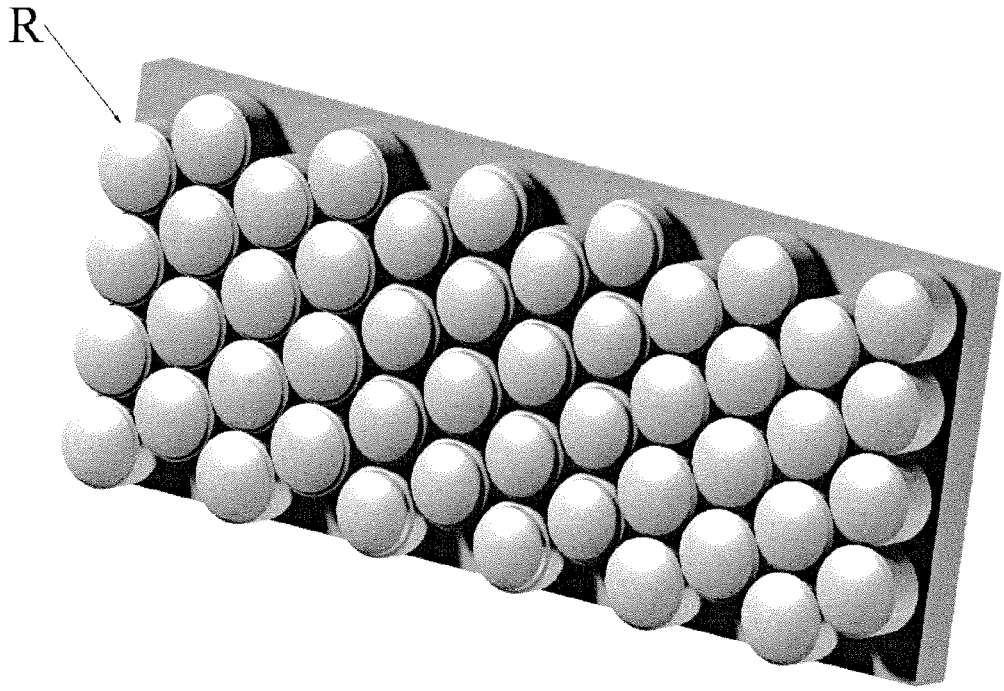

Referring to FIG. 5, the line and fill-in drawings (FIGS. 5A and 5B, respectively) indicate one embodiment of such armor, whereby multiple ceramic bodies are incorporated therein, and moreover, such panels may comprise arrays of several embodiments of such ceramic bodies, for example, arranged in a pattern such that different types of ceramic bodies may be positioned at a desired location along an X or Y Cartesian axis, as depicted in this example. In some embodiments, the panel may comprise only a single type of ceramic body, of any desired type, or in some embodiments, the pattern of arrangement of two or more types of ceramic bodies may be altered to suit a particular purpose.

In some embodiments, the ceramic bodies and composite armor of this invention can be adapted to suit known composite armor and armor applications, for example, as described in U.S. Pat. Nos. 4,665,794, 4,179,979; 3,705,558; 4,945,814 5,763,813 or U.S. application Ser. Nos. 09/048, 628 and 08/944,343 and represent contemplated embodiments of this invention. The skilled artisan will appreciate that additional related applications are also envisioned.

In another aspect of the present invention there is provided a composite armor comprising a panel provided with at least one layer of a plurality of high density ceramic bodies as herein described, and wherein such bodies are arranged in a plurality of adjacent rows and columns, the major axis of said bodies being in substantially parallel orientation with each other and substantially perpendicular to an adjacent surface of said panel.

As will be realized, said panel will normally have substantially parallel surfaces and the integrally formed convexly curved impact receiving end faces of such bodies will be directed to one of the surfaces when the major axis of such bodies are substantially perpendicular to an adjacent surface of the panel. In some embodiments, it is contemplated that the panels can also be curved, in which case the arrangement of the ceramic bodies within the panel will be modified to suit accordingly, as will be appreciated by the skilled artisan.

In an embodiments of this aspect of the present invention there is provided a composite minor comprising a panel consisting essentially of a single internal layer of a plurality of high density ceramic bodies as herein described directly bound and retained in panel by a solidified material, wherein such bodies are arranged in a plurality of adjacent rows and columns, the major axis of said bodies being in substantially parallel orientation with each other.

In some embodiments of the present invention such panel has an inner and an outer surface, with the outer surface facing the impact side and embodied ceramic bodies being arranged in a plurality of adjacent rows, the cylinder axis of said bodies being substantially parallel with each other and perpendicular to the surfaces of the panel with the integrally formed convexly curved impact receiving end faces of each of such ceramic bodies directed to the outer surface and said composite armor further comprises an inner layer adjacent said inner surface of said panel, said inner layer being formed from a plurality of adjacent layers, each layer comprising a plurality of unidirectional coplanar anti-ballistic fibers embedded in a polymeric matrix, where, in some embodiments, the fibers of adjacent layers are at an angle of between about 45° to 90° to each other.

According to a further aspect of the invention, there is provided a multi-layered composite armor panel, comprising an outer, impact-receiving layer formed by a shock absorbing panel as hereinbefore defined; and an inner layer adjacent to said outer layer and, comprising a ballistic material for absorbing any remaining kinetic energy from the impacting projectile and consequences thereto. It will be appreciated that the ballistic material may be any that is appropriate for the desired task, as will be known to the skilled artisan, for example, the choice of material may reflect considerations of cost and weight, as well as the desired properties for the expected impacting projectile. In some embodiments, the material may comprise, but is not limited to Dyneema, Kevlar, aluminum, steel, titanium, or S2, or combinations thereof.

In other embodiments of the present invention, a composite armor panel of this invention may comprise an outer, impact receiving panel of a multi-layered armor panel further comprising an inner layer adjacent to said outer plate, comprising a second ballistic panel, wherein said outer plate, inter glia serves to deform and shatter an impacting high velocity armor-piercing projectile and said second ballistic panel is adapted to retain any remaining fragments from said projectile and from said bodies and to absorb remaining energy from said fragments. According to this aspect, and in some embodiments, the second ballistic panel can be made of any suitable ballistic material including but not limited to aluminium, titanium, Kevlar®, Dyneema®, S2, and combinations thereof.

In other embodiments of the present invention, according to this aspect, the plate may constitute an outer impact receiving panel, a second ballistic panel as defined above as well as comprising a third backing layer for absorbing trauma.

In some embodiments, according to this aspect, the third layer is formed of a polymeric matrix composite with reinforcing fibers or from metals of high modulus of elongation and tearing strength such as aluminum and titanium.

According to this aspect, and in other embodiments, the composite armor may comprise two or more backing plates located proximally to the layer comprising the ceramic pellets as herein described, and positioned distally from a point of impact of an incoming projectile, such that, according to this aspect, the layer of ceramic pellets are, in some embodiments located directly proximally to a first backing plate or backing layer, which is then separated by a void or space, following which is placed an additional backing plate or layer. According to this aspect, and in some embodiments, such positioning of multiple backing plates including the incorporation of a space layer or void, provides for greater energy absorption and in some embodiments, dissipation, which will in turn, according to this aspect mitigate the effects of the incoming projectile.

In some embodiments, the composite armor of this invention will be so arranged such that a compact array of a ceramic body in direct contact with 4 adjacent ceramic bodies is envisioned.

In some embodiments, each of a majority of the pellets along an edge of the plate is in direct contact with four adjacent pellets, while internal pellets in a plurality of rows within the plate are in direct contact with six adjacent pellets.

In some embodiments, the composite armor of this invention will be so arranged such that a compact array of a ceramic body in direct contact with 6 adjacent ceramic bodies is envisioned, whereby such armor has a greater weight per square foot or meter than does an array wherein each pellet is in contact with only 4 adjacent pellets.

In some embodiments, the composite armor of this invention will be so arranged such that the ceramic bodies are arranged in a plurality of adjacent rows and columns, the major axis of said bodies being in substantially parallel orientation with each other and wherein a majority of each of said bodies is in direct contact with six adjacent bodies, with the flanks of three adjacent bodies forming a contact valley therebetween.

In some embodiments, the composite armor of this invention will comprise a plate as herein described, comprising a single internal layer of the embodied ceramic bodies, which are bound and retained in plate form by an elastic material substantially internally within said elastic material, such that the ceramic bodies are bound in a plurality of spaced-apart rows and columns, and such ceramic bodies are substantially fully embedded in the elastic material so that the ceramic bodies form an internal layer, characterized in that a majority of each of such ceramic bodies are in direct contact with four diagonally-adjacent ceramic bodies in the same layer to provide mutual lateral confinement there-between and are retained in a spaced-apart relationship relative to ceramic bodies in the same row and ceramic bodies in the same column by the elastic material.

According to another embodied aspect of the invention there is provided an armor plate comprising a plurality of ceramic bodies and an elastic material in which the ceramic bodies are embedded, the ceramic bodies being arranged in a layer consisting of a plurality of parallel rows of ceramic bodies and a plurality of parallel columns of ceramic bodies, with the columns being substantially perpendicular to the rows, wherein for each one of said rows the ceramic bodies of said each row are spaced from one another and for each one of said columns the ceramic bodies of said each column are spaced from one another, wherein each of a majority of the ceramic bodies contacts two ceramic bodies in a first adjacent row and two ceramic bodies in a second adjacent row so that each of a majority of the ceramic bodies is in contact with four, and four alone, adjacent ceramic bodies, and wherein for each row, the centres of adjacent ceramic bodies in said each row are spaced from one another by a first distance and for each column the centers of adjacent ceramic bodies in said each column are spaced from one another by a second distance, wherein the first distance is different from the second distance.

The invention provides for a method for producing the high density ceramic bodies as herein described, said method comprising:

a. applying a ceramic powder to a mold, said mold comprising:
   i. a removable segmented top pressure applicator, which applicator comprises:
      1. a terminal segment having a proximal and distal portion relative to the direction of the application of pressure via said applicator, which proximal portion is concavely curved, and which distal portion is characterized by:
         a. lateral regions comprising at least a portion which is convex in configuration;
         or
         b. lateral regions comprising a substantially smooth angled configuration; and
   ii. a pellet, which pellet is substantially cylindrical in shape and possesses at least one flat or circular bottom end, sides and an top end,
   wherein said top pressure applicator removably inserts into said pellet of said mold; and
b. applying said top pressure applicator to said mold and applying pressure to said mold via said top pressure applicator;
whereby upon application of said pressure to said mold, a high density ceramic pellet of this invention is produced.

In some embodiments, the invention provides a method comprising:

a. applying a ceramic powder to a mold, said mold comprising:
   iii. a removable segmented top pressure applicator, which applicator comprises:
      1. a terminal segment having a first and second portion relative to the direction of the application of pressure via said applicator, which first section is proximal to said direction of the application of pressure and said second section is distal to said direction of the application of pressure and wherein said first section is concavely curved, and which second section is characterized by:
         a. lateral regions comprising at least a portion which is convex in configuration;
         or
         b. lateral regions assuming a configuration that extends in a straight line; and
   iv. a pellet, which pellet is substantially cylindrical in shape and possesses at least one flat or circular bottom end, sides and an top end,
   wherein said top pressure applicator removably inserts into said pellet of said mold; and
c. applying said top pressure applicator to said mold and applying pressure to said mold via said top pressure applicator;
whereby upon application of said pressure to said mold, the high density ceramic pellet of claim 22 is produced.

Figure 4A:
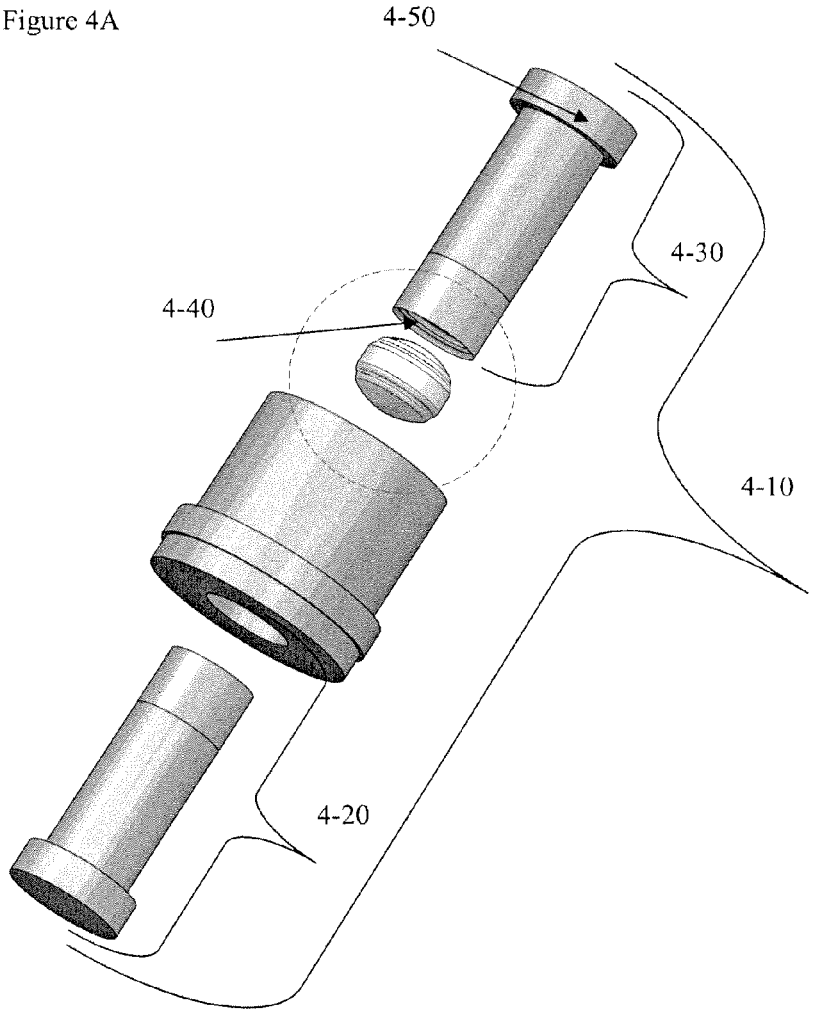
FIG. 4 schematically depicts an embodiment of a mold for use in certain embodiments of the methods as herein described, for use in the preparation of a ceramic pellet of this invention.
FIG. 4B represents a longitudinal section of 4-30 depicted in FIG. 4A.

Referring to FIG. 4, and representing certain embodiments of the invention, the mold 4-10 is evident, which in this aspect contains a bottom support or "punch" 4-20, which, for example, may be fixedly or removably positioned in the mold, and a body of the mold which body may contain at least one void into which the ceramic powder and upper pressure applicator may insert. It will be appreciated that additional voids and supports may be incorporated into a single mold body to prepare multiple ceramic bodies of this invention in parallel, or each mold may represent a mold for individual ceramic body formation.

According to this aspect, and in some embodiments, the mold will also comprise a removable segmented top pressure applicator 4-30. Such applicator comprises a first terminal segment, 4-40, which is concavely curved, which concavely curved segment is flanked by lateral segments characterized by a. a region comprising at least a portion which is convex in configuration; or
b. a region comprising a substantially smooth angled configuration; and such applicator may further comprise a second terminal segment 4-50, which is located distally to said first terminal segment, and proximally to a pressure source.

FIG. 4B more clearly depicts the interior of the first terminal segment 4-40, wherein the concavely curved segment flanked by the described lateral segments is more readily viewed.

According to this aspect, and in some embodiments, such method is particularly appropriate for cold-pressing formation of the ceramic bodies of this invention. Such ceramic bodies are so constructed as to have the added advantage of comprising less cracking, since previously, insertion of the applicator within the mold resulted in the potential formation of a vacuum such that upon release of the applicator, the formed ceramic body may be difficult to remove, and may be marked by a series of cracks formed during release. The unique structure of the ceramic bodies embodied in the present invention may server to diminish such cracking.

The present invention also provides a method for producing a composite armor plate as defined hereinabove, comprising providing an additional mold having a bottom, two major surfaces, two minor surfaces and an open top, inserting a first bottom row of said ceramic bodies into said mold in spaced apart relationship so as to form a first row of ceramic bodies and then adding further ceramic bodies to form a plurality of superposed rows of ceramic bodies extending substantially along the entire distance between said minor side surfaces, and from said bottom substantially to said open top; wherein due to the spacing between the ceramic bodies of the first bottom row, each subsequent superposed row is also formed with a spaced apart relationship between ceramic bodies of the same row and then incrementally heating said mold and the ceramic bodies contained therein to a temperature of at least 100° C. above the flow point of the material to be poured in the mold; pouring molten material into said mold to fill the same; allowing said molten material to solidify; and removing said composite armor plate from said mold.

As will be realized, when preparing the composite armor plate of the present invention, said ceramic bodies do not necessarily have to be completely covered on both sides by said solidified material, and in some embodiments, the term internal layer refers to pellets completely or in some embodiments, almost completely, or in some embodiments, partially, or in some embodiments, substantially covered by said solidified material, wherein outer face surfaces of the plate are formed from the solidified material, the plate having an outer impact receiving face, at which face each ceramic body is either covered by the solidified material, touches said solidified material which forms surfaces of said outer impact receiving face or, not being completely covered by said solidified material which constitutes surfaces of said outer impact receiving face, bulges therefrom, the solidified material and hence the plate being elastic.

The invention provides advantages over known and previously described ceramic pellets for incorporation within composite armor, as will be appreciated by the skilled artisan. While not wishing to be bound by the herein-under described theory, it is known that when manufacturing/preparing ballistic ceramic pellets for incorporation within armored panels, which pellets must withstand exposure to high impact projectiles, typically, when a domed structure is prepared on the impact receiving end of such cylinders, a burr structure may be created between the curved dome and the body of the cylinder, which is typically removed by the polishing process, creating a substantially ninety degree angle between the end of the domed region and the underlying cylindrical body. Such structure, in effect, comprises a weak point on the impact receiving face of the pellet, as the region is much weaker and more likely to be a point of breakage when absorbing the impact of the incoming projectile. In contrast, the ceramic pellets of this invention specifically prevent such straight angled regions at the juncture between the edge of the dome and the joint region with the cylindrical body, creating a region not only stronger in terms of its ability to resist the impact, but in fact, specifically drawing the area of impact away from such regions to areas on the pellet, which are more capable of withstanding the impact of the incoming projectile. It will be apparent to the skilled artisan that the above-described improvement represents only one potential improvement over known ceramic pellets, and others will be appreciated by the skilled artisan, and the pellets are not restricted to showing such improvement or showing such improvement exclusively.

The terms "attached", "attachment", "affixed" and grammatical forms thereof as used herein refer to any operational joining or proximal localization, which is permanent, and is not meant to be detached by design, unless further qualified herein as being "semi-detachable". Any hardware or mechanism to effect such operational joining known in the art is contemplated herein and is to be considered as part of this invention. Support structures referred to herein which are noted to be removably attached are therefore understood to be "semi-detachable".

It is to be understood that repeated use of reference characters in the present specification and drawings is intended to represent the same or analogous features of the invention.

It will be understood by those skilled in the art that various changes in form and details may be made therein without departing from the spirit and scope of the invention as set forth in the appended claims. Those skilled in the art will recognize, or be able to ascertain using no more than routine experimentation, many equivalents to the specific embodiments of the invention described herein. Such equivalents are intended to be encompassed in the scope of the claims.

In the claims articles such as "a,", and "the" mean one or more than one unless indicated to the contrary or otherwise evident from the context. Claims or descriptions that include "or" or "and/or" between members of a group are considered satisfied if one, more than one, or all of the group members are present in, employed in, or otherwise relevant to a given product or process unless indicated to the contrary or otherwise evident from the context. The invention includes embodiments in which exactly one member of the group is present in, employed in, or otherwise relevant to a given product or process. The invention also includes embodiments in which more than one, or all of the group members are present in, employed in, or otherwise relevant to a given product or process. Furthermore, it is to be understood that the invention provides, in various embodiments, all variations, combinations, and permutations in which one or more limitations, elements, clauses, descriptive terms, etc., from one or more of the listed claims is introduced into another claim dependent on the same base claim unless otherwise indicated or unless it would be evident to one of ordinary skill in the art that a contradiction or inconsistency would arise. Where elements are presented as lists, e.g. in Markush group format or the like, it is to be understood that each subgroup of the elements is also disclosed, and any element(s) can be removed from the group. It should it be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in haec verba herein.

The invention includes reference to assemblies comprising a recited list of elements, however it is to be understood with respect to the recited and claimed assemblies, that while additional elements may be incorporated within the assemblies of the invention, the term "comprising" is to be construed as "consisting" of these elements alone. In some embodiments of the invention, reference to the term "comprising" with respect to the recited list of elements of the claimed assemblies of this invention, is to include an assembly "consisting essentially of" such elements, where the term "consisting essentially of" such element refers to the fact that the minimal elements required for the proper functioning of the assembly are the recited elements thereto, however additional elements, which contribute to superior functioning of the claimed assembly, which impart properties unrelated to the protection afforded by the assembly from blast-associated energy, but nonetheless impart desired characteristics to the assembly are included within such definition.

Certain claims are presented in dependent form for the sake of convenience, but Applicant reserves the right to rewrite any dependent claim in independent format to include the elements or limitations of the independent claim and any other claim(s) on which such claim depends, and such rewritten claim is to be considered equivalent in all respects to the dependent claim in whatever form it is in (either amended or unamended) prior to being rewritten in independent format.

What is claimed is:

1. An integrally formed high density ceramic pellet for use in a ballistic armor plate, said ceramic pellet having a longitudinally extending body portion and an impact receiving end face wherein at least a major portion of said body portion is either circular or hexagonal in cross-section and said impact receiving end face comprises:

an impact receiving proximal segment; and a distal segment;

wherein said proximal segment is convexly curved and said distal segment of said impact receiving end face merges with a nominally designated top surface of said body portion, wherein said distal segment of said end face comprises lateral surfaces characterized by:

a region comprising at least a portion which is concave in configuration; or a region comprising a substantially smooth angled configuration, wherein a cross-sectional area of said distal segment at the area of merger is greater than a cross-sectional area taken across a nominally designated base of said proximal segment and wherein the length of the contour line of the outer surface of the distal segment in longitudinal cross-section is between 5 and 25% of that of the length of the contour line of the entire integrally formed impact receiving end face in longitudinal cross-section.

2. The high density ceramic pellet of claim 1, wherein said ceramic pellet has a ratio D/R between the diameter D of said ceramic pellet and the radius R of curvature of said convexly curved end face which ratio is at least 0.64:1.

3. The high density ceramic pellet of claim 1, wherein the relative ratios H/D/R of the height H of said cylindrical pellet, excluding the height of said end face, the diameter of said pellet D, and the radius R of curvature of said at least one convexly curved end face is between about 7.5:12.8:9 and 7.5:12.8:20.

4. The high density ceramic pellet of claim 1, wherein said ceramic pellet is provided with two convexly curved end faces.

5. The high density ceramic pellet of claim 1, wherein the contour of said integrally formed impact receiving end face in longitudinal cross-section comprises two convex arcs of different radii, a first of said arcs being located along the surface of said proximal segment; and a second convex arc being located along the surface of said distal segment.

6. The high density ceramic pellet of claim 1, wherein said pellet has an $Al_2O_3$ content of at least 85% by weight and a specific gravity of at least at 2.5 g/cm3.

7. The high density ceramic pellet of claim 1, wherein said ceramic pellet has an $Al_2O_3$ content of at least 90% by weight and a specific gravity of at least 3 g/cm3.

8. The high density ceramic pellet claim 1, wherein said ceramic pellet is comprised of boron carbide, titanium dibromide, silicon carbide, magnesium oxide, silicon aluminum oxynitride, aluminum oxide or mixtures thereof.

9. The high density ceramic pellet of claim 1, wherein said distal segment is frustroconical in shape.

10. The high density ceramic pellet of claim 1, wherein said lateral surfaces are characterized by a region comprising a substantially smooth angled configuration.

11. The high density ceramic pellet of claim 1, wherein said smooth angled region ascribes an acute angle with said nominally designated top surface of said body portion.

12. The high density ceramic pellet of claim 1, wherein said substantially convexly curved impact receiving end face is comprised of a plurality of individual fragments, which fragments when assembled together assume a convexly curved geometry.

13. A composite ballistic armor plate, comprising a panel provided with a layer of a plurality of high density ceramic pellets of claim 1, wherein said pellets are arranged in a plurality of adjacent rows and columns, the major axis of said pellets being in substantially parallel orientation with each other and substantially perpendicular to an impact receiving surface of said panel.

14. A composite armor of claim 13, wherein said columns are substantially perpendicular to said rows and wherein for each of one of said rows, the ceramic pellets of said each row are spaced from one another and for each of one of said columns the ceramic pellets of said each column are spaced from one another such that each of a majority of said ceramic pellets contacts two pellets in a first adjacent row and two pellets in a second adjacent row, so that each of a majority of the pellets is in contact with four and four alone, adjacent pellets, and where for each row, the centers of adjacent ceramic pellets in said each row are spaced from one another substantially by a first distance for each column the centers of adjacent ceramic pellets in each said column are spaced from one another substantially by a second distance, wherein the first distance is different from the second distance.

15. The composite armor of claim 14, wherein one of said first and second distances is greater than the other one of said first and second distances by a factor of at least from 1.1 to 1.5.

16. The composite armor of claim 14, wherein said ceramic pellets are embedded in an elastic material.

17. The composite armor according to claim 13, wherein said panel has an inner and an outer surface, said outer surface facing the impact side and said ceramic pellets being arranged in a plurality of adjacent rows, the cylindrical axis of said pellets being substantially parallel with each other and perpendicular to the surfaces of the panel with the convexly curved end faces directed to the outer surface.

18. The composite armor according to claim 17 further comprising an inner layer adjacent said inner surface of said panel, said inner layer being formed from a plurality of adjacent layers, each layer comprising a plurality of unidirectional coplanar anti-ballistic fibers embedded in a polymeric matrix, the fibers of adjacent layers being at an angle of between about 45° to 90° to each other.

19. A composite ballistic armor plate, comprising a panel provided with a layer of a plurality of high density ceramic pellets of claim 1, wherein said pellets are arranged in a plurality of adjacent rows and columns, the major axis of said pellets being in substantially parallel orientation with each other and wherein a majority of each of said pellets is in direct contact with six adjacent pellets, with the flanks of three adjacent pellets forming a contact valley therebetween.

20. A composite ballistic armor plate, according to claim 13, wherein a majority of each of said pellets is substantially in contact with at least three adjacent pellets, further characterized in that spaces formed between said adjacent cylindrical pellets are only partially filled with a material for preventing the flow of soft metal from impacting projectiles through said spaces, said flow-preventing material being integrally formed as part of a special insert pellet, said insert pellet being in the form of a cylinder provided with projections extending only partially into the spaces formed between the sides of six adjacent cylindrical pellets, and blocking a major cross-sectional portion of said spaces, each of said projections being in spaced-apart relationship to al least one of the two adjacent cylinders towards which it projects, said pellets being bound and retained in plate form by a solidified material, wherein said solidified material and said plate are elastic.

21. A method for producing the high density ceramic pellet of claim 1, said method comprising:

d. applying a ceramic powder to a mold, said mold comprising:
   i. a removable segmented top pressure applicator, which applicator comprises:
      1. a terminal segment having a proximal and distal portion relative to the direction of the application of pressure via said applicator, which proximal portion is concavely curved, and which distal portion is characterized by:
         a. lateral regions comprising at least a portion which is convex in configuration; or
         b. lateral regions comprising a substantially smooth angled configuration; and
   ii. a pellet, which pellet is substantially cylindrical in shape and possesses at least one flat or circular bottom end, sides and an top end,
   wherein said top pressure applicator removably inserts into said pellet of said mold; and e. applying said top pressure applicator to said mold and applying pressure to said mold via said top pressure applicator;

whereby upon application of said pressure to said mold, the high density ceramic pellet of claim 1 is produced.

22. A ceramic pellet for use in a ballistic armor plate, said ceramic pellet comprising:

a body portion, comprising:

an axis;

a cross-sectional shape that is symmetrical around the axis; and an end portion representing a terminus of said body portion, said end portion having an outer surface comprising a first and second section, wherein:

said first section has a convex curvature; said first section is spaced from said body portion, and said first section contains a body portion axis extending there-through; and said second section extends around said body portion axis, said second section is located between said first portion and said body portion; and said second section has a first annular edge at or adjacent to said first section and a second annular edge at or adjacent to said body portion;

wherein said second section has a configuration such that substantially each intersection between said second section and planes including a body portion axis extends in a straight line or a configuration such that substantially each intersection between said second section and planes including said body portion axis extends in a line that has a concave curvature when viewed from the exterior of said pellet;

and an end portion;

wherein an average radial distance from said body portion axis to said first annular edge of said second section is at lest 5% less than an average radial distance from said body portion axis to said second annular edge of said second section.

23. The pellet of claim 22, wherein the cross-sectional shape of said body portion is circular or hexagonal.

24. The pellet of claim 22, wherein said outer surface of said end portion is formed substantially entirely by said first section and said second section.

25. The pellet of claim 22, wherein said first and second annular edges are circular.

26. The pellet of claim 22, wherein said first and second annular edges are hexagonal.

27. The pellet of claim 22, wherein said first section of said outer surface is comprised of a plurality of individual fragments, which fragments when assembled together assume a convexly curved geometry.

28. A composite ballistic armor plate, comprising a panel provided with a layer of a plurality of pellets of claim 22, wherein said pellets are arranged in a plurality of adjacent rows and columns, the major axis of said pellets being in substantially parallel orientation with each other and substantially perpendicular to an impact receiving surface of said panel.

29. A composite armor of claim 28, wherein said columns are substantially perpendicular to said rows and wherein for each of one of said rows, the ceramic pellets of said each row are spaced from one another and for each of one of said columns the ceramic pellets of said each column are spaced from one another such that each of a majority of said ceramic pellets contacts two pellets in a first adjacent row and two pellets in a second adjacent row, so that each of a majority of the pellets is in contact with four and four alone, adjacent pellets, and where for each row, the centers of adjacent ceramic pellets in said each row are spaced from one another substantially by a first distance for each column the centers of adjacent ceramic pellets in each said column are spaced from one another substantially by a second distance, wherein the first distance is different from the second distance.

30. The composite armor of claim 28, wherein one of said first and second distances is greater than the other one of said first and second distances by a factor of at least from 1.1 to 1.5.

31. The composite armor of claim 28, wherein said ceramic pellets are embedded in an elastic material.

32. The composite armor according to claim 28, wherein said panel has an inner and an outer surface, said outer surface facing the impact side and said ceramic pellets being arranged in a plurality of adjacent rows, the cylindrical axis of said pellets being substantially parallel with each other and perpendicular to the surfaces of the panel with the convexly curved end faces directed to the outer surface.

33. The composite armor according to claim 28 further comprising an inner layer adjacent said inner surface of said panel, said inner layer being formed from a plurality of adjacent layers, each layer comprising a plurality of unidirectional coplanar anti-ballistic fibers embedded in a polymeric matrix, the fibers of adjacent layers being at an angle of between about 45° to 90° to each other.

34. A composite ballistic armor plate, comprising a panel provided with a layer of a plurality of pellets of claim 22, wherein said pellets are arranged in a plurality of adjacent rows and columns, the major axis of said pellets being in substantially parallel orientation with each other and wherein a majority of each of said pellets is in direct contact with six adjacent pellets, with the flanks of three adjacent pellets forming a contact valley therebetween.

35. A composite ballistic armor plate, according to claim 28, wherein a majority of each of said pellets is substantially in contact with at least three adjacent pellets, further characterized in that spaces formed between said adjacent cylindrical pellets are only partially filled with a material for preventing the flow of soft metal from impacting projectiles through said spaces, said flow-preventing material being integrally formed as part of a special insert pellet, said insert pellet being in the form of a cylinder provided with projections extending only partially into the spaces formed between the sides of six adjacent cylindrical pellets, and blocking a major cross-sectional portion of said spaces, each of said projections being in spaced-apart relationship to at least one of the two adjacent cylinders towards which it projects, said pellets being bound and retained in plate form by a solidified material, wherein said solidified material and said plate are elastic.

36. A method for producing the high density ceramic pellet of claim 1, said method comprising:

a. applying a ceramic powder to a mold, said mold comprising:

i. a removable segmented top pressure applicator, which applicator comprises:

1. a terminal segment having a first and second portion relative to the direction of the application of pressure via said applicator, which first section is proximal to said direction of the application of pressure and said second section is distal to said direction of the application of pressure and wherein said first section is concavely curved, and which second section is characterized by:

a. lateral regions comprising at least a portion which is convex in configuration; or b. lateral regions assuming a configuration that extends in a straight line; and ii. a pellet, which pellet is substantially cylindrical in shape and possesses at least one flat or circular bottom end, sides and an top end, wherein said top pressure applicator removably inserts into said pellet of said mold; and f. applying said top pressure applicator to said mold and applying pressure to said mold via said top pressure applicator;

whereby upon application of said pressure to said mold, the high density ceramic pellet of claim 22 is produced.

* * * * *